US005109597A

United States Patent [19]

Elder et al.

[11] Patent Number: 5,109,597

[45] Date of Patent: May 5, 1992

[54] BACKWIRED 3-D HARNESS TOOL ASSEMBLY

[75] Inventors: Cary S. Elder, Murray; Dennis K. Tolman, Brigham City, both of Utah; Dale A. Gates, Irvine, Calif.

[73] Assignee: Northrop Corporation, Hawthorne, Calif.

[21] Appl. No.: 668,281

[22] Filed: Mar. 12, 1991

[51] Int. Cl.[5] ..... B21F 27/12

[52] U.S. Cl. ..... 29/721; 29/755; 29/760; 140/92.1

[58] Field of Search ..... 29/755, 760, 721, 850; 140/92.1, 93 R

[56] References Cited

U.S. PATENT DOCUMENTS 3,930,524 1/1976 Tarbox ..... 29/755 X
4,711,025 12/1987 De Santo ..... 29/755 X
4,979,544 12/1990 Swindlehurst ..... 29/755 X

*Primary Examiner*—Carl E. Hall
*Attorney, Agent, or Firm*—Terry J. Anderson; Robert B. Block; Karl J. Hoch, Jr.

[57] ABSTRACT

A backwired, three dimensional, electronic jig board assembly comprising a table top formed with a planar, rectangular surface having a plurality of apertures for the laying up of three dimensional wire harnesses thereupon; a plug board extending downwardly at right angles from one long edge of the table top, the plug board having upwardly extending slots from the free edge thereof opposite the edge coupled to the table top, with apertures formed as extensions of each slot for the receipt of connectors and the like; a safety plate extending downwardly from each short edge of the table top and spanning the plug board, each safety plate having a central aperture and a pivot rod fixedly secured thereto; support legs coupled to the pivot rods for the pivoting of the table top and plug board with respect thereto; apertures formed in each safety plate for the receipt of a pin passing through the support legs to secure each safety plate as well as the table top and plug board in any one of a plurality of angular orientations; wheels supported by the support frame for movement of the assembly; and an electrical/light assembly secured over the table top and supported thereabove by post coupled to the support legs.

7 Claims, 2 Drawing Sheets

BACKWIRED 3-D HARNESS TOOL ASSEMBLY

BACKGROUND OF THE INVENTION

Summary of the Invention

This invention relates to a backwired three dimensional (3-D) harness tool assembly and, more particularly, to a jig board to facilitate the laying in of electrical harness wires in a 3-D configuration and to allow computer testing of the electrical harness wires while still layed up on the jig board.

DESCRIPTION OF THE BACKGROUND ART

Traditionally, wire harnesses for use in aircraft and the like have been fabricated by a process which includes laying up the individual wires on a two-dimensional mylar path. The path is on a mylar lay-out template (MLT) which shows the center line of the harness in a basically stretched out or unwrapped configuration. Such MLT's are attached to ply boards, commonly referred to as form boards, for the purpose of stability. Once the wires are routed in accordance with the MLT path, the wires are tied into bundles. Connectors in the form of plugs, receptacles and the like are then attached to the wires to form a harness. The next step is the computer testing of the assembled wired harness.

In the field of wire harness testing, the Ditmco computer is normally utilized. The Ditmco computers are manufactured by Ditmco International of Kansas City, Mo. Normally the assembled harness is first removed from the form board and MLT and then transported by tote to the computer. If rework is required, the harness must be transported back to the form board and MLT for repair. This is a time consuming operation.

Because of the complexity, some harnesses require elaborate wooden ramps to effect 3-D assembly for facilitating the crisscrossing of wires. These set-ups are permanent and costly to change during rework. This constitutes another undesirable feature of known wire harness fabrication techniques.

Various devices are used commercially and are disclosed in the background art for the laying up of wire harness. By way of examples, U.S. Pat. No. 4,442,872 to Gibbons discloses a jig board that is essentially universal to any production size wire harness, has a table top that rotates for ease of wire harness fabrication and wherein the board is provided with an adjustable table top with details which keep the wire harness in place. In addition, U.S. Pat. No. 4,483,373 to Tarbox discloses an electronic jig board similar to that of Gibbons in that it is universal to any production size wire harness and the table top rotates for ease of wire harness fabrication. The Dyksterhouse Patent, U.S. Pat. No. 3,259,968, also discloses a tool which is universal to any production size wire harness and, further, the wire harness is tested while still on the tool. This last feature is also disclosed in U.S. Pat. No. 4,218,745 to Perkins and in U.S. Pat. No. 4,030,029 to Cox. Lastly, U.S. Pat. No. 4,711,025 to DeSanto discloses electronic jig board with adjustable table top details which keep the wire harness in place.

As evidenced by the wide variety of commercial devices as well as the patent literature, including the above referred to patents, a wide variety of devices have been designed for use in the laying up of wire harnesses. No prior patent or commercial device, however, is directed to a device as disclosed and claimed herein.

Accordingly, it is an object of the present invention to provide an improved backwired, three dimensional, electronic jig board assembly comprising a table top formed with a planar, rectangular surface a plurality of apertures for the laying up of three dimensional wire harnesses thereupon; a plug board extending downwardly at right angles from one long edge of the table top, the plug board having upwardly extending slots from the free edge thereof opposite the edge coupled to the table top, with apertures formed as extensions of each slot for the receipt of connectors and the like; a safety plate extending downwardly from each short edge of the table top and spanning the plug board, each safety plate having a central aperture and a pivot rod fixedly secured thereto; support legs coupled to the pivot rods for the pivoting of the table top and plug board with respect thereto; apertures formed in the safety plate for the receipt of a pin passing through the support legs to secure the safety plate as well as the table top and plug board in any one of a plurality of angular orientations; wheels supported by the support frame for movement of the assembly; and an electrical/light assembly secured over the table top and supported thereabove by post couples to the support legs.

It is a further object of the present invention to allow computer testing of a wire harness on the table while the harness is still layed up.

It is a further object of the present invention to lay up wire harnesses in three dimensions with universal positioning supports which provides quick change during rework and which allow for easy wire separation at criss-cross and loop locations.

It is a further object of the present invention to construct a wire harness lay up device which is portable and easily moved from one location to another by one person.

Lastly, it is an object of the present invention to locate a wire harness assembly board for ease of harness fabrication.

The foregoing has outlined some of the more pertinent objects of the present invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjuction with the accompanying drawings.

SUMMARY OF THE INVENTION

The invention is defined by the appended claims with a specific embodiment shown in the attached drawings. For the purposes of summarizing the invention, the invention may be incorporated into an improved backwired, three dimensional, electronic jig board assembly comprising a table top formed with a planar, rectangular surface a plurality of apertures for the laying up of three dimensional wire harnesses thereupon; a plug board extending downwardly at right angles from one long edge of the table top, the plug board having upwardly extending slots from the free edge thereof opposite the edge coupled to the table top, with apertures formed as extensions of each slot for the receipt of connectors and the like; a safety plate extending downwardly from each short edge of the table top and spanning in the plug board, each safety plate having a central aperture and a pivot rod fixedly secured thereto; support legs coupled the pivot rods for the pivoting of the table top and plug board with respect thereto; apertures formed in the safety plate for the receipt of a pin passing through the support legs to secure the safety plate as well as the table top and plug board in any one of a plurality of angular orientations; wheels supported by the support frame for movement of the assembly; and electrical/light assembly secured over the table top and supported thereabove by posts coupled to the support legs.

The invention may also be incorporated into a backwired, three dimensional, electronic jig board assembly comprising a table top formed with a planar, rectangular surface a plurality of apertures for the laying up of three dimensional wire harnesses thereupon; a plug board extending downwardly at right angles from one long edge of the table top, the plug board having upwardly extending slots from the free edge thereof opposite the edge coupled to the table top, with apertures formed as extensions of each slot for the receipt of connectors and the like; a safety plate extending downwardly from each short edge of the table top and spanning the plug board, each safety plate having a central aperture and a pivot rod fixedly secured thereto; and support legs coupled to the pivot rods for the pivoting of the table top and plug board with respect thereto.

The jig board assembly further includes apertures formed in the safety plate for the receipt of a pin passing through the support legs to secure the safety plate as well as the table top and plug board in any one of a plurality of angular orientations. The jig board assembly further includes wheels supported by the support frame for movement of the assembly. The jig board assembly further includes an electrical/light assembly secured over the table top and supported thereabove by posts secured to the support legs. The apertures in the table top include large apertures for the passage of electrical wires to beneath the table top and small apertures for receiving support posts. The jig board assembly further includes a plurality of support posts of varying sizes.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the present invention. It should be appreciated by those skilled in the art that the conception and the disclosed specific embodiment may be readily utilized as a basis for modifying or designing other structures for carrying out the same purposes of the present invention. It should also be realized by those skilled in the art that such equivalent constructions do not depart from the spirit and scope of the present invention as set forth in the appended claims.

DETAILED DESCRIPTION OF THE DRAWINGS

Shown in the various drawings is a device for carrying out the principles of the present invention.

Similar reference numerals refer to similar parts throughout the various drawings.

DETAILED DESCRIPTION OF THE INVENTION

Figure 2:
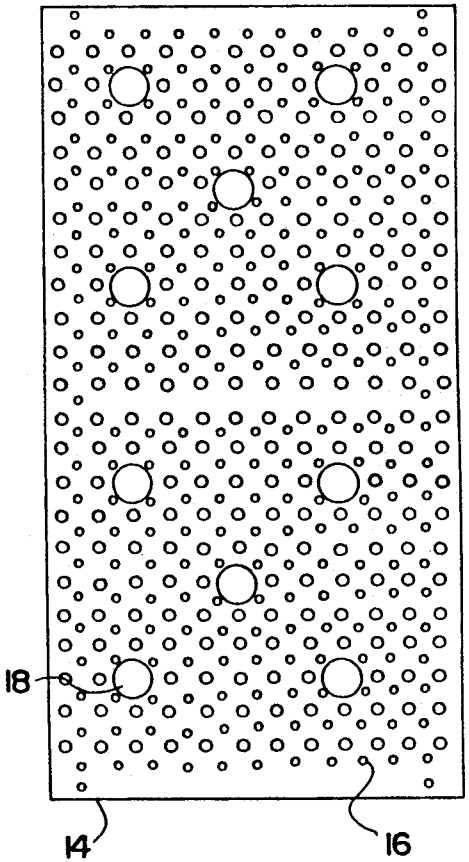
FIG. 2 is a plan view of one of the four like panels of the table top of the harness tool assembly as shown in FIG. 1.
Figure 1:
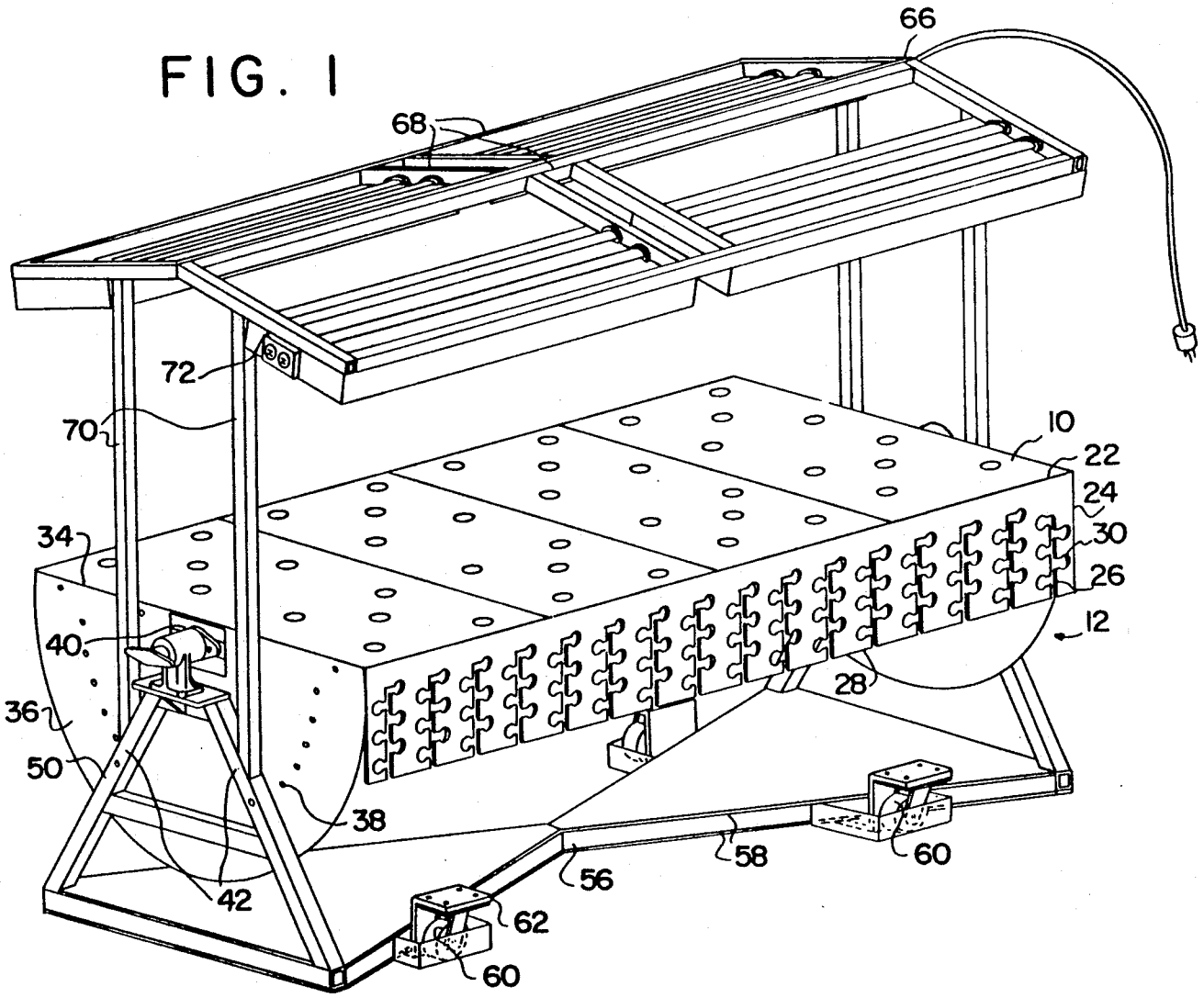
FIG. 1 is a perspective illustration of a backwired 3-D harness tool assembly construction in accordance with the principles of the present invention.

Shown in the drawings, with particular reference to FIG. 1, the present invention is illustrated as including a table top 10 positioned in a horizontal plane but repositionable to essentially any angular orientation with respect thereto. The table top allows harness lay up in three dimensions (3-D) through the particular configuration of the table top and the adjustable assembly 12 for supporting the table top.

Figure 3:
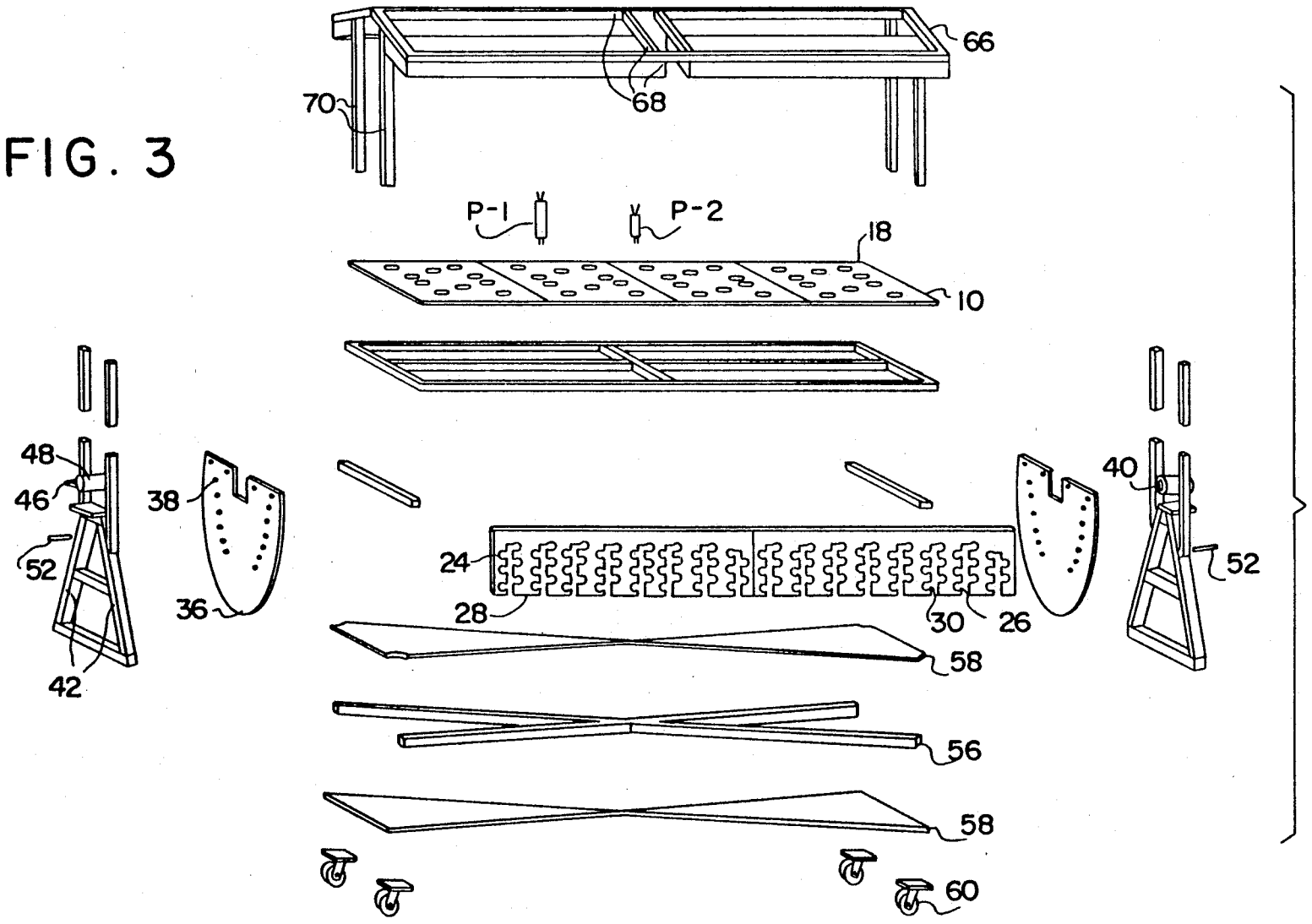
FIG. 3 is an exploded view of the backwired 3-D harness tool assembly shown in FIG. 1.

The table top is formed of a grid work supports receiving a plurality of panels 14, four in the preferred embodiment as shown, but could be readily formed of any appropriate number as a function of the task to be performed. An appropriate grid work supports the panels in a common rigid plane. Each panel is provided with a plurality of small circular apertures or holes 16 around its periphery and in central rows and columns. A plurality of large circular apertures or holes 18 are also provided in rows and columns. The purpose of the different sized holes is to allow back wired harnesses to run from the Ditmco plug board along the lower surface of the table top and through those holes to mate with the connectors that are routed on the table top side of the table top. The smaller holes are post locators. The post locators are holes for removably supporting a predetermined number of conventional posts of varying locations and heights as a function of the harness circuit to be laid up. The posts are formed with clips or the like on their upper surfaces to removably receive and support wires of the harness during the laying up process. One long post P-1 and one short post P-2 are shown in FIG. 3 for purposes of illustration only. The lower ends of the posts are preferably formed with threads for removably coupling to the post locator holes as through nuts. In addition, the post locator holes may also removably receive electrical components of the harness assembly being laid up.

The entire assembly is engineered so that changes in the orientation of the laid-up wiring of harnesses can be quickly incorporated. Nearly 1,000 possible support locations may be effected through its support structure as will be described hereinafter.

Located along one edge 22 thereof, preferably one of the longer edges, is a computer test plug board 24. The plug board is simply formed as a down turned extension of the table top. The plug board is provided with a plurality of slots 26 extending upwardly from its lower edge 28. The slots are parallel one with respect to the other. Each slot is provided with horizontally disposed larger apertures 30 formed as continuations of the slots. The apertures are offset with respect to each other along the lengths of the slots for maximizing the number of apertures on the plug board.

The apertures on the plug board are of such size and shape as to receive the appropriate connectors such as plugs, receptacles and the like. Such connectors are of conventional sizes and configurations. In this manner, such connectors are located for being readily coupled to a test computer in order to determine the propriety with the wire positioning of the layed-up harness.

The positioning of the plug board is sufficient to allow for computer testing while the harness with connectors is still layed up on the table. The configuration of the plug board is such as to reduce the risk of wire damage caused by excessive off board handling which had been required by prior devices and which did not locate the connectors at such convenient locations. As such, reworks can be readily addressed prior to removal from the fixture since the harness remains in a laid-up orientation during the testing.

The production harness is backwired to the table top on its lower surface. This effected through the large holes on the table top. The backwired harnesses are run parallel to the test harness. One (1) of the ends of the backwired harness is run through the large holes in the table top and mated with the test harness. The other end is placed in the computer test plug board in sequental order.

Also located as down turned extensions from edges 34 of the table top are a pair of safety plates 36. Each safety plate is located along one short edge of the table top. The safety plate is provided with a plurality of small apertures 38 in a semi-circular configuration. The semi-circular configuration has as its axis the pivot point for the rotation of the safety plates, table top and plug board. The axis is the center of shafts 40 located in axial alignment on opposite sides of the table top and extending through the safety plates. The shafts are supported on legs 42, preferably in an essentially triangular configuration to maintain the table top, safety plates and plug board at an appropriate height for being worked upon by an operator.

Retention of the table top and plug board horizontally, or in a particular angular orientation, is effected by thumb screws 46 threadedly engaged in bearings 48 which supports the shafts 40. In addition, apertures 50 are formed through the support legs. Each aperture receives a pin 52 which extends through a support leg and into one of the semicircular apertures for additional support in retaining the desired angular orientation of the table top plate and plug board. The location of the safety plate at the ends of the table top prevents injury to workmen as the device is being rotated between positions. The safety plate also allows the pinned trunion locking of the assembly.

At the lower most portions of the support legs is a lower horizontal support 56 in an X-shaped configuration with upper and lower support plates 58. A plurality of wheels 60, of a design which is commercially available, are located in wheel supports 62 to facilitate the movement of the assembly from one location to another. Repositioning of the assembly may be readily effected by a single workman with minimum effort.

Located above the table top is an electrical and light assembly 66. The assembly 66 is supported by its periphery on an open grid work 68. The grid work is, in turn, supported at opposite ends by support beams 70 coupled to the support legs. The light assembly also includes a source of power including electrical outlets 72 and shop air for the operator and the wiring harness upon which he is working. The lighting assembly provides no shadow visibility to assist the operator in laying up the harness on the table top. This support of the electrical/light assembly 66 over the table top and supported there by posts coupled to the support legs allows the fixed, elevated positioning of the electrical/light assembly regardless of the angular positioning of the table top.

Although this back wired table can support any size harness, it is specifically designed for large and complex designs. Clarity of wire separation at the cross-over and breakout locations is provided. The harness testing capability for the board tooling can be reused on any programs. Further, a color code is preferably utilized to visually aid in tracing 3-D paths.

The present invention provides flexible assembly tooling which can be quickly adapted to new engineering harness configuration changes. It provides the capability to manufacture large complex harnesses in true configuration. It also conserves manufacturing floor space by eliminating the need for adjacent jig boards. Further, when used properly, the apparatus reduces scrap while operational flexibility is provided.

The table top panels, as well as all major components of the apparatus, are preferably formed of a stamped sheet metal, as for example, anodized aluminum or the like, for lightness, rigidity, durability, long-life, and the like. All components are preferably painted to an appropriate color or colors.

The present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts made by restored to without departing from the spirit and scope of the invention.

Now that the invention has been described,

What is claimed is:

1. A backwired, three dimensional, electronic jig board assembly comprising:

a table top formed with a planar, rectangular surface having a plurality of apertures for the laying up of three dimensional wire harnesses thereupon;

a plug board extending downwardly at right angles from one long edge of the table top, the plug board having upwardly extending slots from the free edge thereof opposite the edge coupled to the table top, with apertures formed as extensions of each slot for the receipt of connectors;

a safety plate extending downwardly from each short edge of the table top and spanning the plug board, each safety plate having a central aperture and a pivot rod fixedly secured thereto;

support legs coupled to the pivot rods for the pivoting of the table top and plug board with respect thereto;

apertures formed in each safety plate for the receipt of a pin passing through the support legs to secure each safety plate as well as the table top and plug board in any one of a plurality of angular orientations;

wheels supported by the support frame for movement of the assembly; and an electrical/light assembly secured over the table top and supported thereabove by posts coupled to the support legs.

2. A backwire, three dimensional, electronic jig board assembly comprising:

a table top formed with a planar, rectangular surface having a plurality of apertures for the laying up of three dimensional wire harnesses thereupon;

a plug board extending downwardly at right angles from one long edge of the table top, the plug board having upwardly extending slots from the free edge thereof opposite the edge coupled to the table top, with apertures formed as extensions of each slot for the receipt of connectors;

a safety plate extending downwardly from each short edge of the table top and spanning the plug board, each safety plate having a central aperture and a pivot rod fixedly secured thereto; and support legs coupled to the pivot rods for the pivoting of the table top and plug board with respect thereto.

3. The jig board assembly as set forth in claim 2 and further including apertures formed in each safety plate for the receipt of a pin passing through the support legs to secure each safety plate as well as the table top and plug board in any one of a plurality of angular orientations.

4. The jig board assembly as set forth in claim 3 and further including wheels supported by the support frame for movement of the assembly.

5. The jig board assembly as set forth in claim 4 and further including an electrical/light assembly secured over the table top and supported thereabove by post coupled to the support legs.

6. The jig board assembly as set forth in claim 2 wherein the apertures in the table top include large apertures for the passage of electrical wires to beneath the table top and small apertures for receiving support posts.

7. The jig board assembly as set forth in claim 6 and further including a plurality of support posts of varying sizes.

* * * * *